US005475989A

United States Patent [19]

Momjian et al.

[11] Patent Number: 5,475,989

[45] Date of Patent: Dec. 19, 1995

[54] FOLDABLE STIFF METAL CHAIN NECKLACE AND BRACELET

[76] Inventors: Tsolag Momjian, P.O. Box 19379; Hagop Momjian, both of P.O. Box 19379, 91193 Jerusalem, Israel

[21] Appl. No.: 204,643

[22] Filed: Mar. 1, 1994

[51] Int. Cl.[6] ..... A44C 5/00

[52] U.S. Cl. ..... 63/9

[58] Field of Search ..... 63/2, 3, 4, 7, 9; 24/33 P, 33 M, 33 B; 59/78, 80, 95

[56] References Cited

U.S. PATENT DOCUMENTS

| | | | |
|---|---|---|---|
| 1,102,645 | 7/1914 | Cockshaw | 63/2 |
| 1,159,311 | 11/1915 | Wolcott | 63/4 X |
| 1,828,476 | 3/1930 | Seidman et al. | 63/2 |
| 1,895,969 | 1/1933 | Calhoun | 24/33 B |
| 3,324,991 | 6/1967 | Voss | 24/33 P |
| 4,334,413 | 6/1982 | Gaston | 63/2 |
| 5,011,003 | 4/1991 | Gladding | 24/33 PX |
| 5,148,689 | 9/1992 | Azrielant | 63/2 |

FOREIGN PATENT DOCUMENTS

| | | | |
|---|---|---|---|
| 3337889 | 4/1984 | Germany | 63/3 |
| 351779 | 3/1961 | Switzerland | 24/33 P |
| 1574332 | 9/1980 | United Kingdom | 24/33 P |

*Primary Examiner*—Brian K. Green
*Assistant Examiner*—Jerry Redman
*Attorney, Agent, or Firm*—James A. Quinton

[57] ABSTRACT

According to the invention, a crimp and crease resistant metal chain necklace is provided which is composed of adjoining rigid metal chain segments preferably a flat stiff metal chain such as herringbone, serpentine or cobra chain made from a precious metal, preferably gold or silver. The ridged metal chain segments are of the type which are susceptible to crimping and creasing in ordinary usage and which cannot be folded without damaging the chain. The metal chain segments are interconnected by hinged connectors which are preferably integrally attached to such metal chain segments to provide a crimp and crease resistant chain which can be folded to a small size and preferably to about the length of the longest rigid metal chain segment. Preferably the hinged connector includes at least one rod about which the chain segments can pivot. Preferably the rod, is concealed within the necklace to give a smooth, flat appearance.

19 Claims, 2 Drawing Sheets

FIG.1
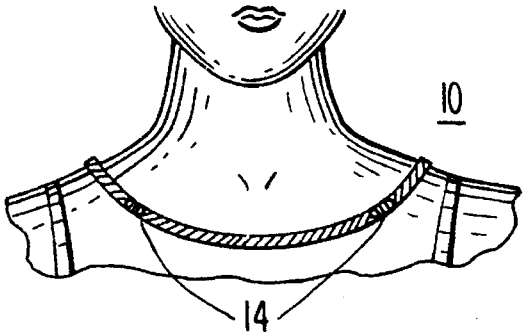
FIG.2
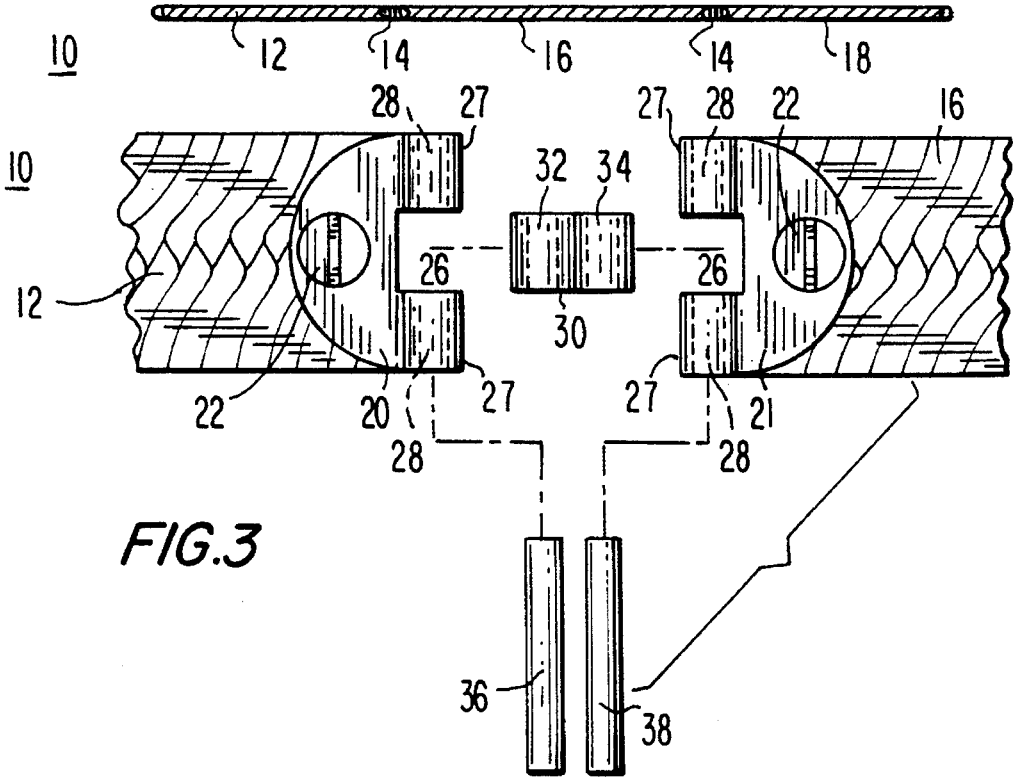
FIG.3
FIG.4
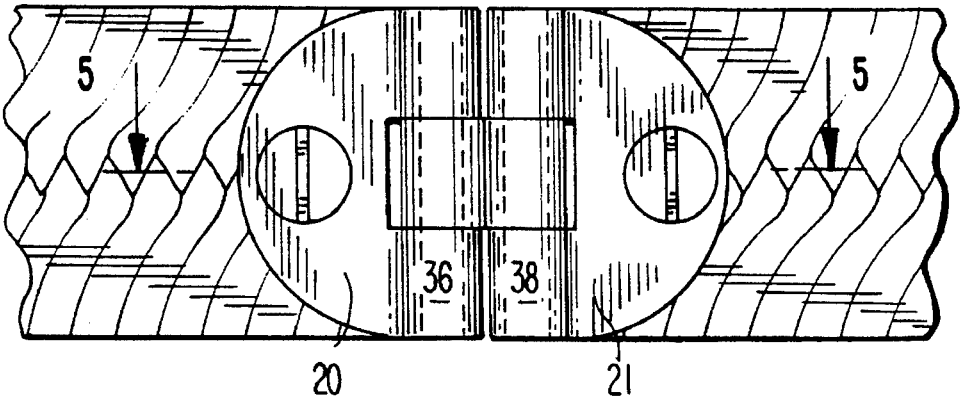

FOLDABLE STIFF METAL CHAIN NECKLACE AND BRACELET

BACKGROUND OF THE INVENTION

1. Field of the Invention

The present invention relates to stiff metal chain jewelry that can be unintentionally damaged due to permanent crimping or creasing in ordinary usage. In particular the invention relates to herringbone chains.

2. Description of the Prior Art

Flat metal chain jewelry particularly made of precious metals such as gold or silver is in widespread use. Such chain jewelry is often sold as necklaces or bracelets. Examples of such flat chain jewelry are herribone, serpentine or cobra chains. These chains suffer from the disadvantage that they are stiff and inflexible. As a result, they are subject to permanent crimping, folding and or creasing during ordinary use and storage. Such necklaces can be permanently creased by merely folding the chain between two fingers.

Herringbone necklaces and bracelets are very popular. Generally herribone chains are manufactured by taking a readily machine manufacturable link chain and subjecting it to hammering or pounding. The resulting chain is a thin, flat, stiff chain which can be permanently and irreversibly crimped, folded or creased during normal use or storage. Such chains have to be stored in long boxes so that the chains will not be crimped or creased. Moreover, in use, such chains are easily ruined by unintentional bending.

Connectors for jewelry are known in the prior art. Such connectors have been used to connect a jewelry element to a chain. See U.S. Pat. No. 5,148,689 (Azrielant). Also chain link jewelry is also known. See U.S. Pat. No. 1,102,645 (Cockshaw).

SUMMARY OF THE INVENTION

According to the invention a rigid or semi-rigid stiff metal chain preferably a herringbone chain for use as a necklace or as a bracelet is provided which has interspersed with the rigid or semi-rigid metal chain, one or more flexible connectors preferably two or more hinged connectors mounted to the stiff metal chain. Desirably the connectors will pivot around a pin and allow the chain to be easily folded preferably flat folded without permanently deforming or creasing the chain.

According to the invention a necklace or bracelet made from rigid or semi-rigid stiff flat metal chain is provided which is resistant to crimping and which can be folded for placement in a small container without creasing or crimping the metal chain. In another aspect of the invention a herringbone chain necklace is provided preferably having at least three herringbone chain segments which have been interconnected together by at least two hinged connectors integrally attached to the chain segments to provide an attractive flat continous unitary necklace. The resulting necklace is resistant to crimping and creasing in ordinary use or storage.

According to the invention a stiff metal chain preferably a flat metal chain necklace such as herringbone, serpentine or cobra chain is provided by joining together three or more segments of the flat metal chain preferably gold herringbone with two or more hinged connectors. The flat metal chain segments and the connectors then form an integral flat unitary necklace. According to the invention the necklace can be folded along the hinged connectors so that it will be less likely to be crimped or creased during use and less likely to kink. In addition, the necklace can be folded at the connectors and placed in a small box which has a length of about the length of the longest segment.

In another aspect of the invention a flat stiff chain bracelet such as herringbone, serpentine or cobra, preferably gold herringbone is provided. At least one hinged connector is provided along the bracelet. As a result a crimp and crease resistant bracelet is provided.

It is an object to the invention to provide a necklace made out of rigid or semi-rigid stiff flat metal chain which nevertheless can be folded without damaging the chain.

It is an object of the invention to provide a chain necklace made of a rigid or semi-rigid metal chain segments which can be folded and carried in a small jewelry box without damaging the necklace.

It is an object of the invention to provide a necklace made from rigid or semi-rigid stiff chain which is resistant to damage from unintended crimping, folding, bending or creasing.

It is an object of the invention to provide a herringbone necklace which is resistant to crimping and permanent creasing in normal use.

It is an object of the invention to provide a herringbone necklace that can be carried in a box which is less than one-half the length of the chain.

Other further objects will become evident by referring to the appended specifications and drawings.

The preferred embodiment of the present invention is illustrated in the drawings and examples. However, it should be expressly understood that the present invention should not be limited solely to the illustrative embodiment.

DESCRIPTION OF THE DRAWINGS

FIG. 1 is a perspective view of the chain necklace according to the invention in use.

FIG. 2 is a top view of the chain according to the invention.

FIG. 3 is an exploded partial top view of the chain according to the invention with the hinged connector disengaged.

FIG. 4 is a partial top view of the chain according to the invention with the hinged connector engaged.

DETAILED DESCRIPTION OF THE INVENTION

Figure 5:
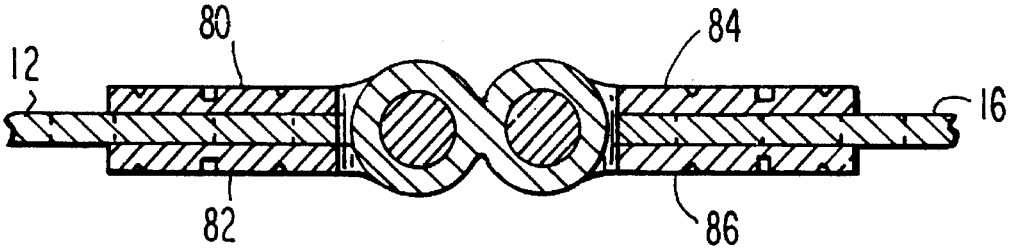
FIG. 5 is a cross section of FIG. 4 through 4—4.

According to the invention, a crimp and crease resistant metal chain necklace is provided which is composed of adjoining rigid metal chain segments, preferably or more. The chain is preferably a flat stiff metal chain such as herringbone, serpentine or cobra chain made from a precious metal, preferably gold or silver. The ridged metal chain segments are of the type which are susceptible to crimping and creasing in ordinary usage and which cannot be folded without damaging the chain. The metal chain segments are interconnected by a hinged connector, preferably two hinged connectors which are preferably integrally attached to such metal chain segments to provide a crimp and crease resistant chain which can be folded to a small size. Preferably the chain can be flat folded to about the length of the longest rigid metal chain segment. Desirably the hinged connector includes at least one rod about which the chain segments can pivot. Preferably the rod is concealed within the necklace to give a smooth, flat appearance.

Referring now to the drawings, as shown in FIGS. 1 and 2 a crease and crimp resistant metal jewelry chain necklace preferably a gold herringbone necklace 10 is provided. As best seen in FIG. 2 the necklace 10 is composed of a plurality of stiff flat metal chain segments 12, 16 and 18. The chain is composed of at least two segments. Preferably at least three (3) chain segments are used. Stiff flat metal chain elements 12, 16 and 18 are preferably a herringbone, serpentine or cobra chain most preferably herringbone chain made from a precious metal such as gold or silver, most preferably gold. The stiff metal chain segments are connected to one another through a hinged connector preferably two or more hinged connectors 14.

As best seen in FIG. 3, hinged connectors 14 preferably are composed of opposed U-shaped keepers 20 and 21 and coupling 30. The U-shaped keepers 20 and 21 are mounted to adjoining chain segments 12, 16 and 18 at each adjoining end. Referring to FIG. 3, segment 16 and segment 12 are shown to have the opposed keepers 20 and 21 mounted to the opposed ends of segments 12 and 16. Preferably the connectors 14 are gold or gold plated so that they blend with the herringbone chain, although optionally they can be made to provide a contrasting appearance, e.g., white gold or silver connectors. Each U-shaped keeper has a tubular channel 28 through legs 27 for receipt of tubular rods 36 and 38. A coupling 30 having tubular channels 32 and 34 is provided for fitting into the hollow 26 in U-shaped keeper 20 and 21. Coupling 30 is mounted into hollow 26 in each opposed U-shaped keeper 20 and 21 so that channel 32 aligns with tubular channel 28 in U-shaped keeper 20 and tubular channel 34 aligns with tubular channel 28 in keeper 21. Rods 36 and 38 are provided for pivotly connecting the keepers 20 and 21. Rod 36 is mounted into the keeper 20 through aligned tubular channels 28 and 32. Rod 38 is mounted into keeper 21 aligned channels 28 and 34 to provide for a hinged connection between the keepers 20 and 21. The channels 28 optionally are slightly crimped to retain the rods. U-shaped keeper 20 has a top plate 80 and an opposed identical bottom plate 82 spaced apart from said top plate 80 for receipt of an end of chain segment 12, 16 or 18. Keeper 21 is similarly constructed with top plate 84 and bottom plate 86. The keeper 20 is mounted to the end of chain 12 by sliding one end of the chain into the space between top and bottom plates 80 and 82 and heat soldering the keeper to the chain. Keeper 21 is secured in the same manner to segment 16 between top and bottom plates 84 and 86. Optionally as shown in FIGS. 3 and 4, decorative screw heads 22 provided on the surface of keepers 20 and 21. However, as shown, they are only decorative. Optionally the keepers can be mounted to the chain in any secure manner such as screwing or riveting. As a result segments 12, 16 and 18 are joined together in a hinged fashion. According to the invention the coupling rods 36 and 38 are attractively hidden in the tubular channels 28 and 32 and 34. As a result when the necklace has been assembled the hinge that is, the pivoting rods 36 and 38 are hidden from view and a smooth flat attractive chain necklace is provided. As shown in FIGS. 3 and 4 there are actually four (4) possible pivot points provided. Segment 12 can pivot around rod 36 and rotate independently of segment 16. Similarly segment 16 can rotate around rod 38 as the pivot point and rotate independently of segment 12. Coupling 30 also rotates about rod 36 and rod 38. As a result, a very flexible hinged connection is provided.

Figure 6:
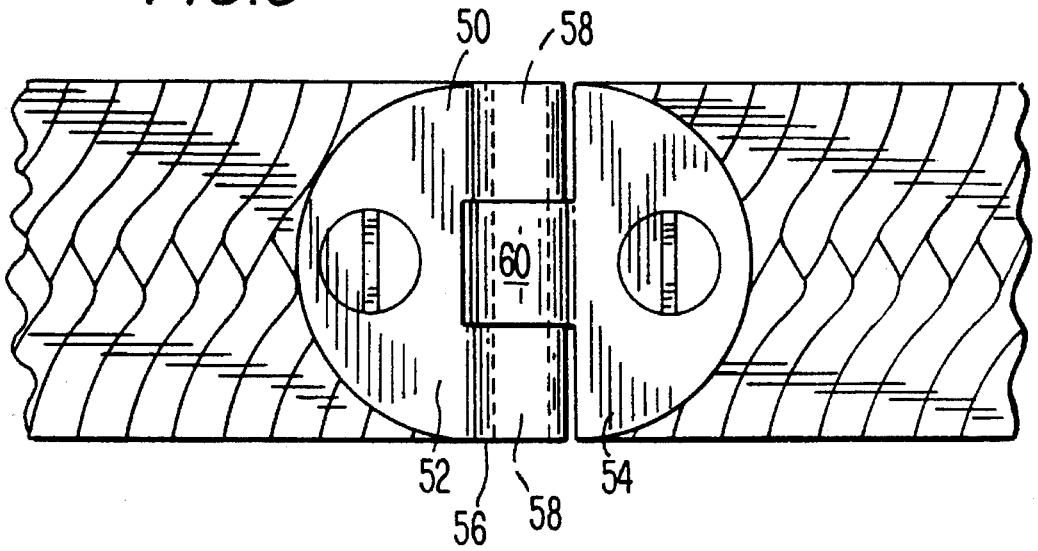
FIG. 6 is a top view of an alternate connector for use in the invention.
Figure 7:
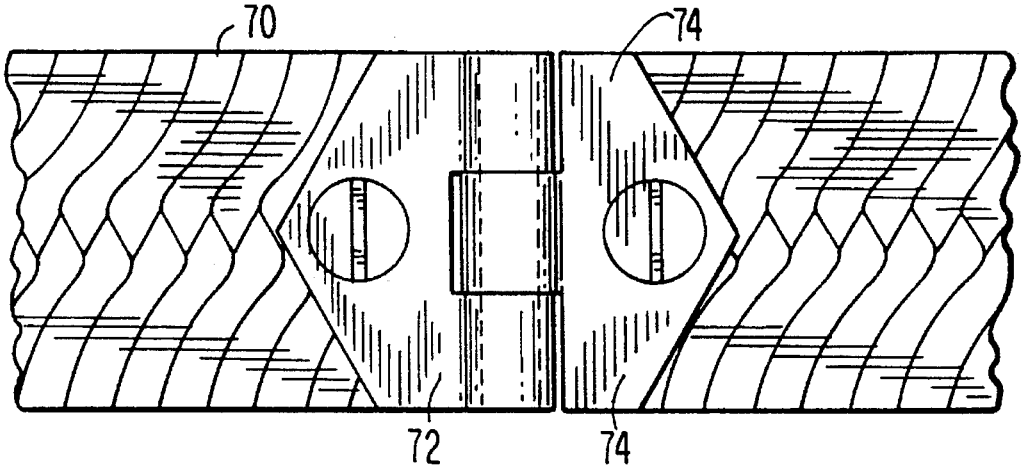
FIG. 7 is a top view of another alternate connector for use in the invention.

Alternately other types of connectors can be provided. As shown in FIG. 6, hinged connector 50 is provided with a U-shaped keeper 52 and a interconnecting member 54 having a projection 62 adapted to fit into the hollow of U-shaped keeper 52. A tubular opening 58 is provided through the legs of U-shaped connector 52. A tubular opening 60 is provided in the projection portion 56 of interconnecting member 54. Rod 58 is then mounted therein. As a result a hinged connection is provided with a single pivot point which conceals pivoting rod from view. FIG. 7 shows an alternate design where the keepers are of a slightly different shape. Thus, in FIG. 7 a connector 70 which is composed of a V-shaped keeper 72 and a mating projecting member 74 are provided. Otherwise the operation is the same as set forth for FIG. 6 with a resulting single hinge connection with a concealed coupling rod.

According to the invention, a necklace which is composed of a plurality of stiff metal segments which are susceptible to crimping and creasing in ordinary use are interconnected into a flat continuous necklace which is resistant to crimping and creasing and which can be folded to a small size is provided. Preferably the necklace can be folded to a size approximately the same as the largest segment of the necklace.

Alternatively a bracelet may be provided. Where a bracelet is provided two or more stiff metal segments are joined together through one or more hinged connectors. As a result the bracelet can be folded to the length of the longest segment. The resulting bracelet is resistant to damage from crimping or creasing.

The foregoing is considered as illustrative only to the principles of the invention. Further, since numerous changes and modifications will occur to those skilled in the art, it is not desired to limit the invention to the exact construction and operation shown and described above, and accordingly all suitable modifications and equivalents may be resorted to, falling within the scope of the invention.

We claim:

1. A piece of jewelry comprising:

a. adjoining stiff metal chain segments that are susceptible to permanent creasing;

b. hinged connector means pivotly attaching each metal segment to the adjoining segment;

a first chain segment and a second chain segment adjoining said first chain segment; said hinged connector means including a first and second pivot rod, said first pivot rod mounted to said first chain segment at one end thereof, said second pivot rod mounted to said second chain segment at the end adjoining said first chain segment so that the first chain segment can pivot about said first pivot rod independently of said second chain segment and said second pivot rod and vice versa;

whereby said jewelry can be folded at each hinged connector to a length approximately equal to the length of a longest chain segment without creasing the jewelry.

2. The jewelry according to claim 1 wherein said jewelry is a necklace and said hinged connector means includes a rod about which said adjoining metal chain segments pivot;

said rod being mounted internally within said jewelry to conceal said rod from view so that in use said jewelry has a smooth flat appearance.

3. The jewelry according to claim 1 further wherein each said hinged connector means includes, i. a first and second U-shaped keeper having a chain mounting end and a pivot rod attachment end;

ii. said first keeper affixed at said chain mounting end to a chain segment; said second keeper affixed at said chain mounting end to a second chain segment, said second chain segment adjoining said first chain segment in said jewelry;

iii. said first and second keeper having projecting legs separated by a hollow at said pivot rod attachment end;

iv. tubular keeper channels extending through said legs of said first and second keeper;

v. a coupling having a first and second tubular coupling channels mounted in the hollow of both the first and second keeper;

vi. said first tubular coupling channel aligning with said tubular keeper channel in said first keeper; said second tubular coupling channel aligning with said tubular keeper channel in said second keeper;

vii. a first pivot rod mounted through said first tubular coupling channel and said tubular keeper channels in said first keeper; a second pivot rod mounted through said second tubular coupling channel and said tubular keeper channels in said second keeper;

whereby the adjoining metal segments are pivotly connected to one another so that said first chain segment pivots around said first pivot rod and said second chain segment pivots around said second pivot rod so that said chain can be flatly folded at the hinged connectors to a length approximately equal to the length of the longest chain segment without crimping or creasing the jewelry.

4. The jewelry according to claim 3 further comprising, said coupling pivotly mounted to said first and second coupling rods so that such said coupling pivots about said first rod and said second rod independent of said metal chain segments.

5. The jewelry according to claim 4, further comprising, said first and second keepers having at said chain end, a top plate and an opposed bottom plate;

said bottom plate spaced apart from said top plate for receipt of an end of said metal chain segment;

securing means to secure said metal chain segments between said top and bottom plates of said first and second keeper.

6. The piece of jewelry according to claim 1 wherein said jewelry is a necklace having at least three adjoining stiff metal chain segments and having at least two hinged connector means pivotly attaching each metal segment to the adjoining segment.

7. A necklace according to claim 6 wherein said stiff metal chain segments are cobra, serpentine or herringbone chains.

8. A necklace according to claim 7 wherein stiff metal chain segments are made from a precious metal.

9. A necklace according to claim 8 wherein said precious metal is gold or silver.

10. A necklace according to claim 9 wherein said stiff metal chain is gold herringbone.

11. A necklace comprising:

a. at least three adjoining stiff metal chain segments that are susceptible to permanent creasing;

b. at least two hinged connector means pivotly attaching each metal chain segment to the adjoining segment;

c. each said hinged connector means including, i. a first and second U-shaped keeper having a chain mounting end and a pivot rod attachment end;

ii. said first keeper affixed at said chain mounting end to a chain segment; said second keeper affixed at said chain mounting end to a second chain segment, said second chain segment adjoining said first chain segment in said necklace;

iii. said first and second keeper having projecting legs separated by a hollow at said pivot rod attachment end;

iv. tubular keeper channels extending through said legs of said first and second keeper;

v. a coupling means having a first and second tubular coupling channels mounted in the hollow of both the first and second keeper;

vi. said first tubular coupling channel aligning with said tubular keeper channel in first said keeper; said second tubular coupling channel aligning with said tubular keeper channel in said second keeper;

vii. a first pivot rod mounted through said first tubular coupling channel and said tubular keeper channels in said first keeper; a second pivot rod mounted through said second tubular coupling channel and said tubular keeper channels in said second keeper;

whereby the adjoining metal segments are pivotly connected to one another so that said first chain segment pivots around said first pivot rod and said second chain segment pivots around said second pivot rod so that said necklace can be flatly folded at the hinged connector means to a length approximately equal to the length of a longest chain segment without creasing the necklace.

12. A necklace according to claim 11 further comprising, said coupling means pivotly mounted to said first and second coupling rods so that such said coupling pivots about said first rod and said second rod independent of said metal chain segments.

13. A necklace according to claim 12, further comprising, said first and second keepers having at said chain end, a top plate and an opposed bottom plate;

said bottom plate spaced apart from said top plate for receipt of an end of said metal chain segment;

securing means to secure said metal chain segments between said top and bottom plates of said first and second keeper.

14. A necklace according to claim 13, wherein said securing means is heat soldering said top and bottom plates of said keepers to an end of said metal chain segment.

15. A necklace according to claim 11, wherein said stiff metal chain segments are cobra, serpentine or herringbone chain made of gold or silver.

16. A necklace according to claim 15, wherein said stiff metal chain segments are gold herringbone.

17. A necklace according to claim 15, wherein said hinged connectors are made of a precious metal.

18. A necklace according to claim 11, wherein said chain segments and said hinged connector means form a flat, smooth necklace and wherein said pivot rods are hidden within the smooth flat necklace.

19. A necklace according to claim 11, wherein said chain segments and said hinged connector means form a continuous integral chain necklace.

* * * * *